US006189356B1

(12) United States Patent
Simeone et al.

(10) Patent No.: US 6,189,356 B1
(45) Date of Patent: Feb. 20, 2001

(54) METHOD AND APPARATUS FOR PEENING

(75) Inventors: Peter A. Simeone, Byfield; Apostolos P. Karafillis, Cambridge; Joan E. Bissett, Rowley; Douglas A. Wilson, Beverly, all of MA (US)

(73) Assignee: General Electric Company, Cincinnati, OH (US)

( * ) Notice: Under 35 U.S.C. 154(b), the term of this patent shall be extended for 0 days.

(21) Appl. No.: 09/563,000

(22) Filed: Apr. 24, 2000

Related U.S. Application Data

(60) Provisional application No. 60/183,092, filed on Feb. 17, 2000.

(51) Int. Cl.[7] ..... B21J 3/00
(52) U.S. Cl. ..... 72/53; 29/90.7
(58) Field of Search ..... 72/53; 29/90.7

(56) References Cited

U.S. PATENT DOCUMENTS 3,482,423 * 12/1969 Murray et al. ..... 72/53

* cited by examiner

*Primary Examiner*—David Jones
(74) *Attorney, Agent, or Firm*—Andrew C. Hess; Gerry S. Gressel

(57) ABSTRACT

A mask for masking a corner of a metal component during peening. The component has a first surface defining an opening in the component and a second surface intersecting the first surface of the component at the corner. The mask includes a plug sized and shaped for insertion in the opening adjacent to the corner to cover the corner during peening. Further, the mask includes a rim surrounding at least a portion of the plug sized and shaped for surrounding at least a portion of the opening to cover the corner during peening thereby preventing the corner from being peened.

15 Claims, 3 Drawing Sheets

METHOD AND APPARATUS FOR PEENING

CROSS REFERENCE TO RELATED APPLICATION

This application claims the benefit of U.S. Provisional Application No. 60/183,092, filed Feb. 17, 2000.

BACKGROUND OF THE INVENTION

The present invention relates generally to methods and apparatus for peening components and more particularly to a method and apparatus which prevent damage to corners of components during peening.

Metal components such as those used in gas turbine engines are peened to induce compressive surface stresses. These compressive stresses inhibit crack formation and growth in the component. Because peening inhibits crack formation and growth, peened components generally have longer fatigue lives than unpeened components. However, high intensity peening (e.g., peening to Almen intensities greater than about 0.005 A) sometimes damages corners of components resulting in lower fatigue lives. The corners which are susceptible to damage include corners surrounding holes in components. The damage occurs when the corners are smeared, curled or bent over by the force of peening media hitting the corner during high intensity peening. The bent corners form notches which concentrate stress. Further, the metal at the corners becomes brittle as it is bent. The stress concentrations and brittleness increase the likelihood of crack formation and increase the speed of crack growth in the component.

To determine if corners are damaged by peening, the corners can be inspected following peening. If a damaged corner is found, the component is scrapped or reworked to remove the damaged area. However, corners usually are not inspected for peening damage and peening damage is controlled by controlling the peening process.

SUMMARY OF THE INVENTION

Among the several features of the present invention may be noted the provision of a mask for masking a corner of a metal component during peening. The component has a first surface defining an opening in the component and a second surface intersecting the first surface of the component at the corner. The mask includes a plug sized and shaped for insertion in the opening adjacent to the corner to cover the corner during peening. Further, the mask includes a rim surrounding at least a portion of the plug sized and shaped for surrounding at least a portion of the opening to cover the corner during peening thereby preventing the corner from being peened.

In another aspect, the present invention comprises a combination including a metal component having a first surface and a second surface intersecting the first surface at an external corner and a corner mask positioned at the corner of the component. The mask is made of a material which is resistant to damage from peening. The mask is sized and shaped for covering the corner to protect the corner from damage during peening. Further, the mask is sized and shaped to permit at least a portion of the first surface and at least a portion of the second surface to be peened when the mask is positioned at the corner of the component.

In yet another aspect, the present invention includes a method of peening a metal component. The method comprises the steps of positioning a mask over the corner of the component, peening the first surface of the masked component at a first intensity and peening the second surface of the masked component at a second intensity. Further, the method includes removing the mask from the corner of the component and peening the corner of the component at a third intensity less than the first intensity and the second intensity.

Other features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
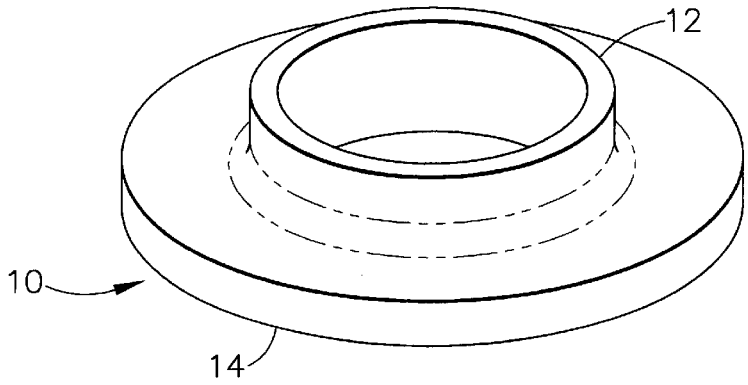
FIG. 1 is a perspective of a mask of the present invention.

Referring now to the drawings and in particular to FIG. 1, a mask of the present invention is designated in its entirety by the reference number 10. The mask 10 generally comprises a plug 12 and a rim 14 surrounding at least a portion of the plug. Although the mask 10 may be made of other materials without departing from the scope of the present invention, the mask 10 of the preferred embodiment is molded from a material which is resistant to damage from peening such as nylon, rubber or polyethylene. Preferably, the material is also sufficiently soft so the mask 10 does not scratch the component, generally designated 20 (FIG. 2), with which it is used.

The mask 10 is specifically adapted for masking a particular corner of a particular metal component during peening. For example, the particular component 20 may be a high pressure turbine disk of a gas turbine engine. The disk 20 has a first surface 22 defining an opening, generally designated by 24, in the component. Further, the component 20 has a second surface 26 intersecting the first surface 22 of the component at a corner 28. The second surface 26 of the component 20 is generally annular and extends around a centerline 30 of the disk. The component 20 may also include other conventional features such as a dovetail slot 32. Although the corner 28 may have other corner treatments such as a round edge or a break edge without departing from the scope of the present invention, the corner of one preferred embodiment includes a nominal 0.020 inch chamfer.

Figure 2:
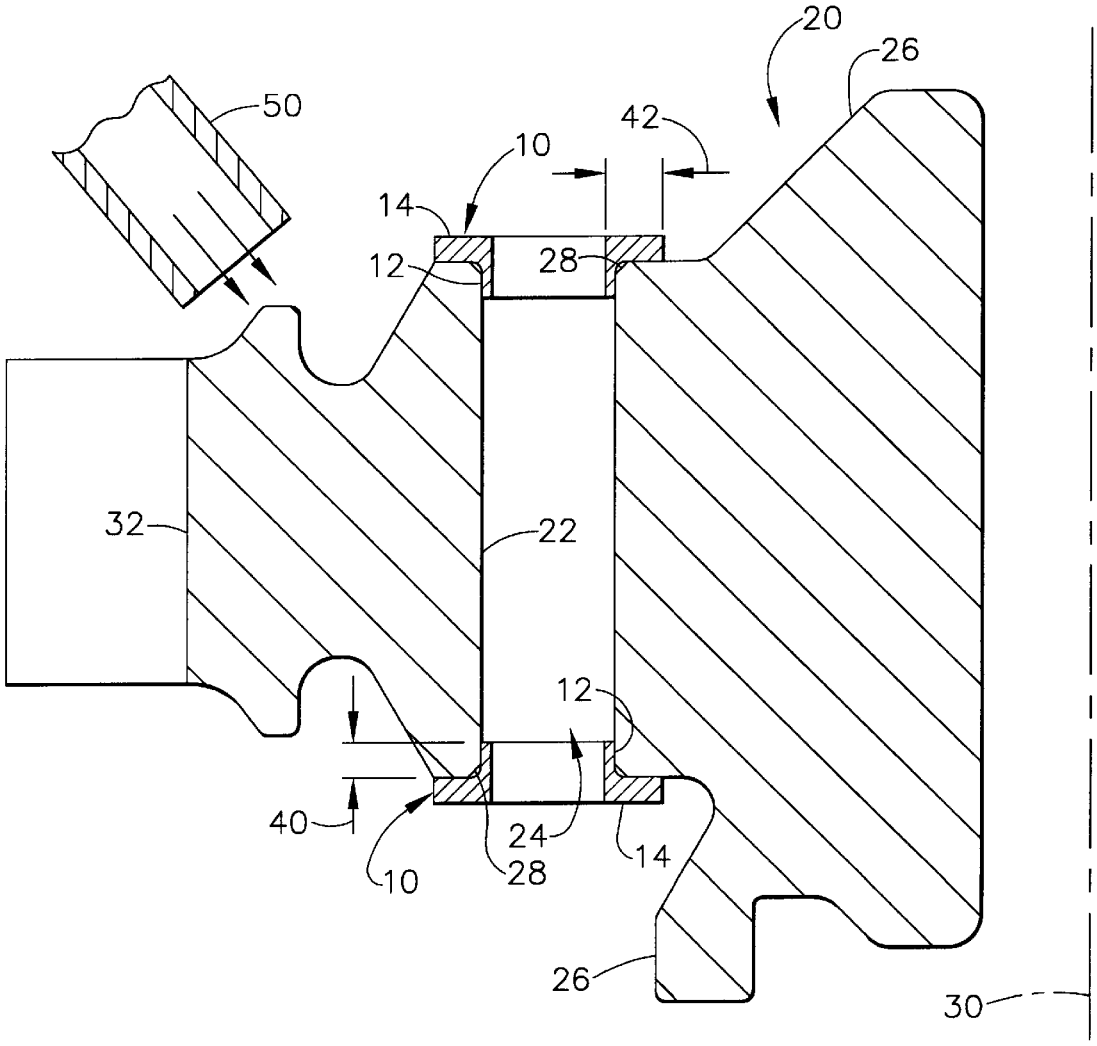
FIG. 2 is a partial cross section of a metal component having masks installed in a hole in the component as an exterior surface of the component is peened.

As further illustrated in FIG. 2, the plug 12 is sized and shaped for insertion in the opening 24 adjacent to the corner 28 to cover the corner during peening. For example, if the opening 24 is a cylindrical hole having a diameter of about 0.300 inches, the plug 12 includes a cylindrical exterior having a slightly larger diameter for frictionally engaging the opening in the component 10 to form an interference fit. The interference fit prevents peening media from traveling between the plug 12 and the surface 22 defining the opening 24 and permits the plug to be removed from the opening after peening the first and second surfaces 22, 26, respectively, to permit the corner to be peened at a lower intensity. Further, the plug 12 is tubular as shown in FIG. 2 to permit access to the interior surface 22 of the opening 24 in the component 20. The plug 12 may be held in place by a clamp (not shown).

The rim 14 is sized and shaped for surrounding at least a portion of the opening 24 to cover the corner 28 during peening thereby preventing the corner from being peened. Although the rim 14 may have other shapes without departing from the scope of the present invention, in one preferred embodiment the rim is annular.

Preferably, the plug 12 and rim 14 are sized for covering the corner 28 and any corner treatment (e.g., a chamfer) during peening and for leaving sufficient portions of the first and second surfaces 22, 26, respectively, exposed to permit peening of those surfaces. For example, the plug 12 may have a nominal length 40 of about 0.075 inches and the rim 14 may have a nominal width 42 generally equal to the length of the plug when the plug is used to cover a corner 28 having a 0.020 inch chamfer. Further, the length 40 of the plug 12 is selected to hold the mask 10 in position in the opening 24. Although the minimum length 40 of the plug 12 and the minimum width 42 of the rim 14 must be sufficient to cover the corner 28 and any corner treatment, the maximum length and width are not particularly critical. Preferably, the maximum length 40 and width 42 are minimized to expose the greatest surface area of the first and second surfaces 22, 26, respectively, for peening, but this preference is somewhat offset by a desire to allow large tolerances on the mask 10 dimensions for manufacturing convenience.

A procedure for using the mask 10 described above is shown in FIGS. 2–4. First, the mask 10 is positioned over the corner 28 of the component 20 as shown in FIG. 2. With the mask 10 in place, the exposed portions of the first and second surfaces 22, 26, respectively, are peened to conventional intensities (e.g., equal Almen intensities between about 0.004 A and about 0.008 A). As shown in FIG. 2, the second surface 26 of the component 20 is peened with a conventional shot peening apparatus, generally designated by 50 using a conventional procedure. The component 20 may be positioned on a turntable (not shown) as the second surface 26 is peened. Further, a different mask such as an annular plate (not shown) may be used to cover more than one opening 24 as the second surface 26 is peened.

Figure 3:
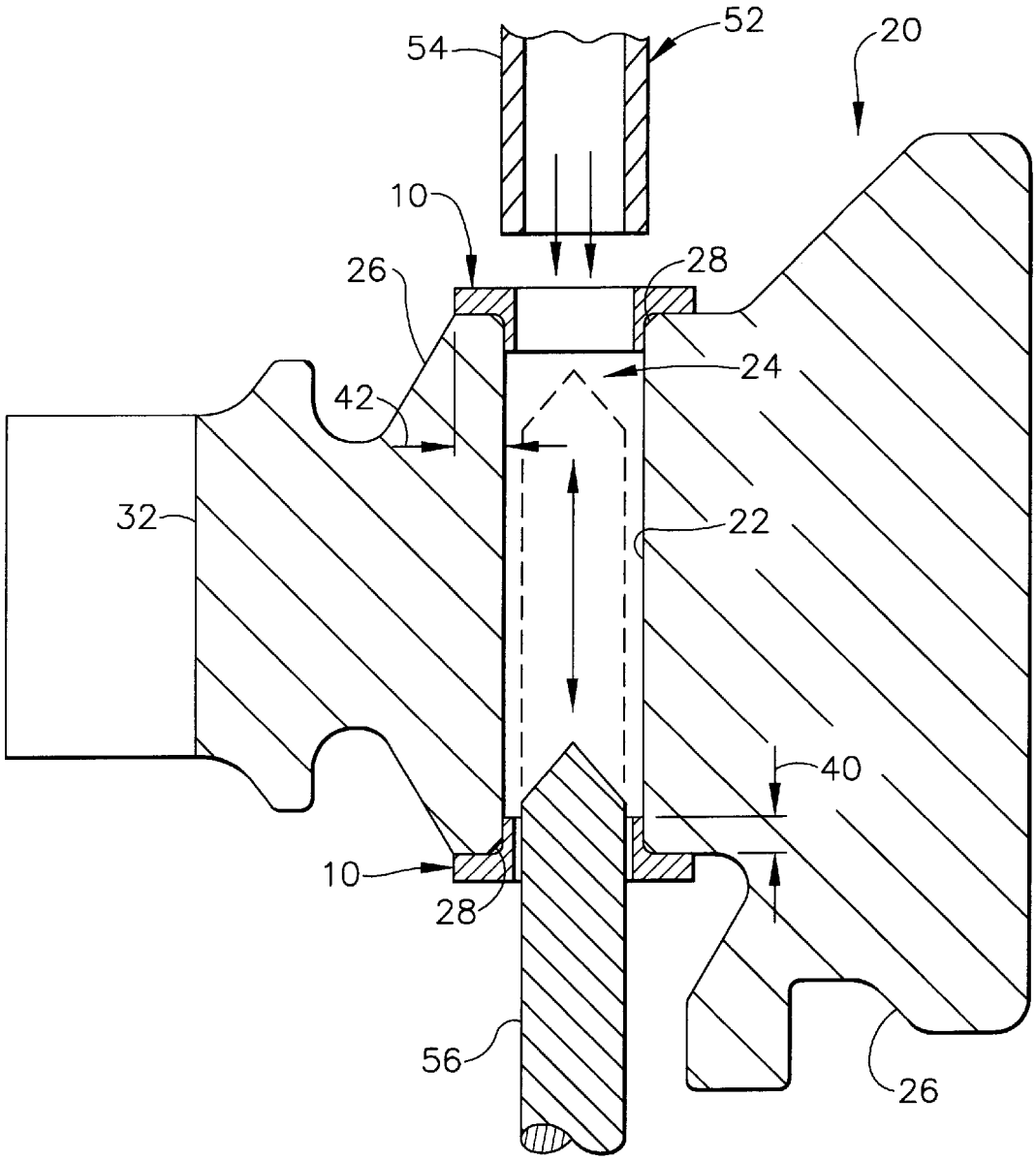
FIG. 3 is a partial cross section of the component having masks installed as an interior surface of the hole is peened.

As illustrated in FIG. 3, the first surface 22 of the component 20 is peened using a conventional deflection shot peening apparatus, generally designated 52, comprising a nozzle 54 for delivering peening media to the opening 24 and a reciprocating deflector 56 for directing the media toward the surface 22. Although a deflection peening apparatus is used in one preferred embodiment, it is envisioned that other conventional peening apparatus such as lance peening apparatus (not shown) may be used without departing from the scope of the present invention.

Figure 4:
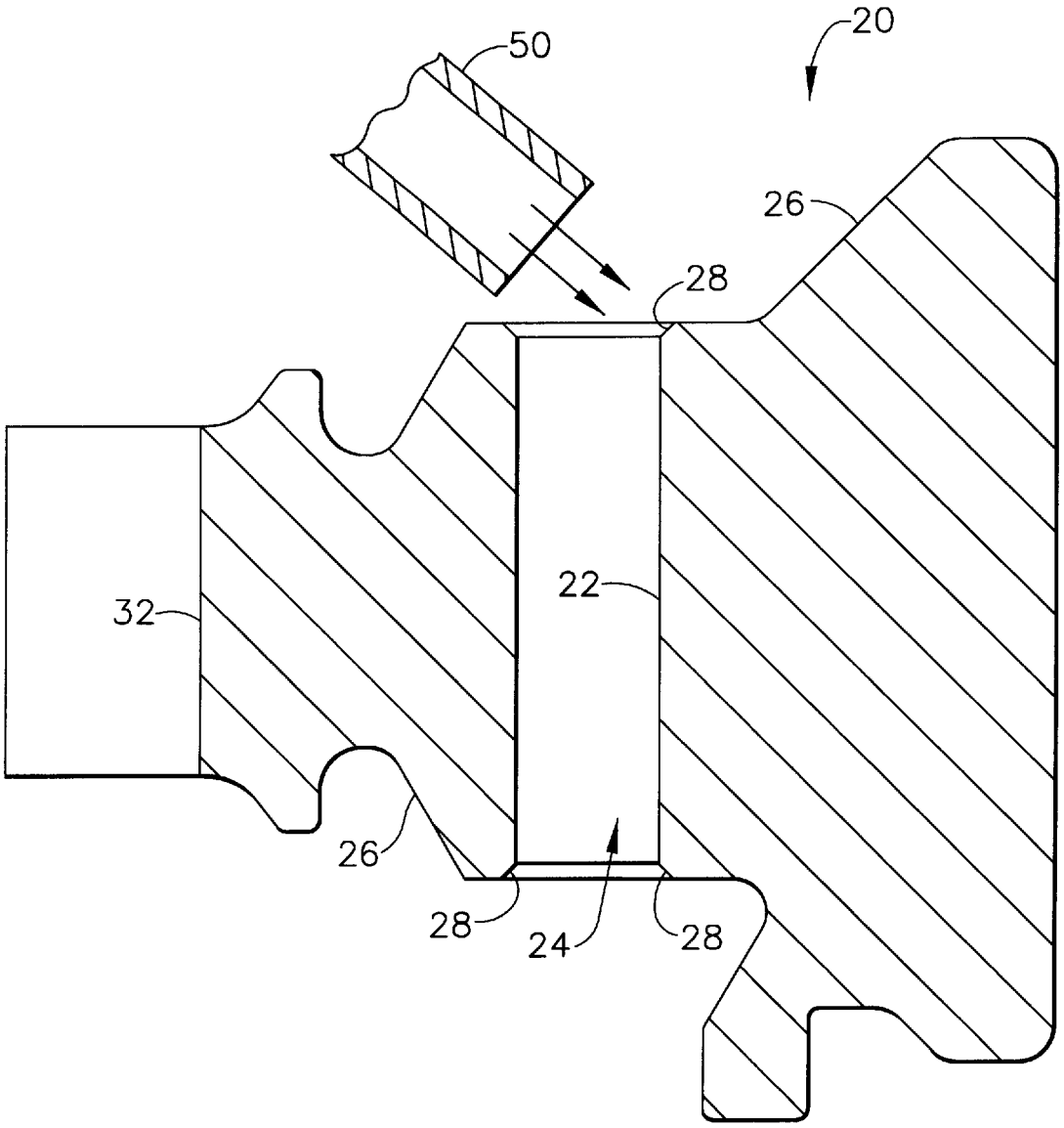
FIG. 4 is a partial cross section of the component having masks removed as a corner between the hole and the exterior surface of the component is peened.

Once the first and second surfaces 22, 26 are peened, the mask 10 is removed from the corner 28 of the component 20 to expose the corner for peening as illustrated in FIG. 4. The corner 28 is peened to a lower intensity (e.g., between about 6N and about 12N) selected to prevent damage to the corner.

Using the method described above, most of the first and second surfaces 22, 26 are peened to an optimally desirable intensity selected to impart compressive residual stresses in the component at and immediately below the respective surfaces of the component. The corners 28 are peened to a lower intensity which is selected to prevent damage to the corners. Further, the lower intensity peening imparts some compressive residual stresses in the component. Thus, flaw initiation and propagation is reduced. Further, because the peening intensity is selected to be below a threshold at which damage occurs, significant time and expense associated with inspecting the corners and reworking or scrapping components having damaged corners is avoided.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A mask for masking a corner of a metal component during peening, the component having a first surface defining an opening in the component and a second surface intersecting said first surface of the component at the corner, the mask comprising:

a plug sized and shaped for insertion in the opening adjacent to the corner to cover the corner during peening; and a rim surrounding at least a portion of the plug sized and shaped for surrounding at least a portion of the opening to cover the corner during peening thereby preventing the corner from being peened.

2. A mask as set forth in claim 1 wherein the plug is sized for frictional engagement with said first surface.

3. A mask as set forth in claim 1 wherein the plug is a tubular cylinder.

4. A mask as set forth in claim 3 wherein the rim is annular.

5. A mask as set forth in claim 1 wherein the plug has a length s elected for covering a corner treatment of the corner of the component.

6. A mask as set forth in claim 1 wherein the plug has a length and the rim has a width generally equal to said length.

7. In combination, a metal component having a first surface and a second surface intersecting said first surface at an external corner; and a corner mask positioned at the corner of the component, the mask being made of a material which is resistant to damage from peening, the mask being sized and shaped for covering the corner to protect the corner from damage during peening, and the mask being sized and shaped to permit at least a portion of said first surface and at least a portion of said second surface to be peened when the mask is positioned at the corner of the component.

8. A combination as set forth in claim 7 wherein the mask is removable from the corner of the component to permit the corner to be peened.

9. A combination as set forth in claim 7 wherein said first surface defines an opening in the component.

10. A combination as set forth in claim 9 wherein the opening is a hole.

11. A combination as set forth in claim 10 wherein the hole is cylindrical.

12. A combination as set forth in claim 7 wherein the corner includes a corner treatment and the mask is sized and shaped for covering the corner treatment to protect the corner treatment from damage during peening.

13. A method of peening a metal component having a first surface defining an opening in the component and a second surface intersecting said first surface of the component at the corner, the method comprising the steps of:

positioning a mask over the corner of the component;

peening said first surface of the masked component at a first intensity;

peening said second surface of the masked component at a second intensity;

removing the mask from the corner of the component; and peening the corner of the component at a third intensity less than said first intensity and said second intensity.

14. A method as set forth in claim 13 wherein said second intensity is substantially equal to said first intensity.

15. A method as set forth in claim 13 wherein said third intensity is below a threshold at which damage from peening occurs.

* * * * *